US006280803B1

(12) United States Patent
Gordy, Jr.

(10) Patent No.: US 6,280,803 B1
(45) Date of Patent: Aug. 28, 2001

(54) SIMULATED CHRISTMAS TREE LIGHT DISPLAY

(76) Inventor: Mack L. Gordy, Jr., 1804 Regal La., Greensboro, NC (US) 27410

( * ) Notice: Subject to any disclaimer, the term of this patent is extended or adjusted under 35 U.S.C. 154(b) by 0 days.

(21) Appl. No.: 09/280,139

(22) Filed: Mar. 26, 1999

(51) Int. Cl.[7] ..... A41G 1/00

(52) U.S. Cl. ..... 428/18; 428/20; 428/8; 248/462; 248/165; 211/195; 211/203

(58) Field of Search ..... 428/20, 27, 18, 428/17, 15, 12, 8, 542.2; 248/163.1, 165, 462, 195; 211/175, 189, 203; 135/100; 362/249

(56) References Cited

U.S. PATENT DOCUMENTS

| | | | | |
|---|---|---|---|---|
| D. 360,380 | | 7/1995 | Eckhart | D11/118 |
| D. 390,806 | | 2/1998 | Skarda, Jr. | D11/118 |
| D. 406,077 | | 2/1999 | Cox et al. | D11/118 |
| 2,842,145 | * | 7/1958 | Wilson, Jr. . | |
| 3,251,370 | * | 5/1966 | Tanner . | |
| 3,258,020 | * | 6/1966 | McDonald . | |
| 3,704,366 | | 11/1972 | Korb et al. | 240/10 T |
| 4,396,652 | | 8/1983 | Koehler | 428/17 |
| 4,620,270 | | 10/1986 | Laakso | 362/123 |
| 4,736,282 | | 4/1988 | Ahroni | 362/123 |
| 4,870,547 | | 9/1989 | Crucefix | 362/123 |
| 4,968,541 | | 11/1990 | McCrory | 428/9 |
| 5,359,502 | | 10/1994 | Cantin | 362/123 |
| 5,568,966 | | 10/1996 | Miller et al. | 362/252 |
| 5,712,002 | | 1/1998 | Reilly, III | 428/20 |
| 5,746,504 | | 5/1998 | Dodson | 362/252 |
| 5,758,948 | | 6/1998 | Hale | 362/123 |
| 5,788,361 | | 8/1998 | Lee | 362/249 |
| 5,800,046 | | 9/1998 | Lin | 362/252 |
| 5,823,659 | | 10/1998 | Klose | 362/252 |

* cited by examiner

*Primary Examiner*—Deborah Jones
*Assistant Examiner*—Wendy Boss
(74) *Attorney, Agent, or Firm*—Rhodes & Mason, PLLC

(57) ABSTRACT

A simulated Christmas tree light display having a circular ring and a plurality of elongated legs attached to the ring. Each of the elongated legs has a first end connected to the ring and a second end positioned opposite the ring. The first end has an aperture for threading the ring through the leg and a flattened end section. The apertures are sized to allow the legs to rotate about the ring to form a variety of angled designs. Lights and other holiday decorations may be wrapped about the legs to further provide the appearance of a lighted Christmas tree.

24 Claims, 3 Drawing Sheets

SIMULATED CHRISTMAS TREE LIGHT DISPLAY

BACKGROUND OF THE INVENTION (1) Field of the Invention

The present invention relates generally to a simulated Christmas tree light display and, more particularly, to a simulated Christmas tree light display having adjustable legs which provide for a variety of shapes and sizes.

(2) Description of the Prior Art

Many persons decorate their homes, offices, and yards during the holiday season with a variety of Christmas decorations. One popular display is a lighted simulated Christmas tree that may be used repeatedly for many years. The artificial tree is removed from storage each year during the holiday season, assembled and decorated. At the end of the holidays, the tree is then disassembled and stored until next Christmas. Existing simulated artificial trees offer a variety of choices, but there are drawbacks.

For example, many existing simulated tree light displays have numerous pieces that must be assembled in a particular manner. If one of the pieces is lost or broken, the display either cannot be properly assembled, or if assembled, does not have adequate structural stability. Additionally, the simulated tree may be frustrating to assemble, as the numerous pieces are difficult to place together. This is particularly frustrating for young children who wish to assist with the decorating, but are unable to help because the tree must be set up by an adult.

In addition, many existing simulated Christmas tree light displays can be assembled in only one shape and size. For example, an eight-foot tree having a base of three feet can only be assembled with these dimensions. A different simulated tree light display must be purchased if the user desires to have a different shaped and sized tree. The lack of variations in shape and size limit where the tree can be placed and often results in the Christmas decorations being placed in the same locations and looking the same year after year.

Another drawback of many existing simulated Christmas tree light displays is they are cumbersome to store away when not in use. For example, some simulated Christmas tree light displays cannot be disassembled resulting in the need for a large amount of storage space. Others that disassemble completely have many pieces, screws, connectors, etc. that may become lost during storage. Additionally, many have delicate pieces. These displays must be stored separately since they cannot have other materials packed with them that could crush or damage the pieces. This is difficult for a user because storage space is often limited, especially considering the amount of time the display will be in use relative to the amount of time packed away in storage.

Thus, there is a need for a simple simulated Christmas tree light display which provides the ability to alter the tree dimensions to allow the user to have some variety in decoration options and reduce the cost of purchasing different tree sizes while, at the same time, is easily stored when not in use.

SUMMARY OF THE INVENTION

The present invention is directed to a simulated Christmas tree light display.

The display includes a generally circular ring formed from a ring and a plurality of elongated legs each having a first end and a second end. Each of the legs has a flattened end section having an aperture through which the ring extends to connect the legs. Each of the apertures is sized to allow the legs to pivot about the ring to form a variety of conical-shaped designs. In the preferred embodiment, the ring is a circle having a diameter between about 1-½ and 2-½ inches.

In the preferred embodiment, the display may also include at least one light string wrapped around the display to provide the appearance of a lighted Christmas tree. Ties may be used to attach the light string to adjacent portions of the legs. In addition, the display may include an ornament attached to the ring for providing a top piece for the tree display to more closely simulate a Christmas tree.

Accordingly, one aspect of the present invention is to provide a simulated Christmas tree light display. The display includes a ring formed from an overlapping coil; and a plurality of elongated legs each having a first end and a second end, the first end having an aperture through which the ring extends to connect the legs, each of the apertures being sized to allow the legs to pivot about the ring to form a variety of conical-shaped designs.

Another aspect of the present invention is to provide a simulated Christmas tree light display. The display includes a generally circular ring; and a plurality of elongated legs each having a first end and a second end, the first end having a flattened end section having an aperture through which the ring extends to connect the legs, each of the apertures being sized to allow the legs to pivot about the ring to form a variety of conical-shaped designs.

Still another aspect of the present invention is to provide a simulated Christmas tree light display. The display includes a generally circular ring; a plurality of elongated legs each having a first end and a second end, the first end having a flattened end section having an aperture through which the ring extends to connect the legs, each of the apertures being sized to allow the legs to pivot about the ring to form a variety of conical-shaped designs; and at least one light string wrapped around the display providing the appearance of a lighted Christmas tree and means for attaching the light string to adjacent portions of the legs.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
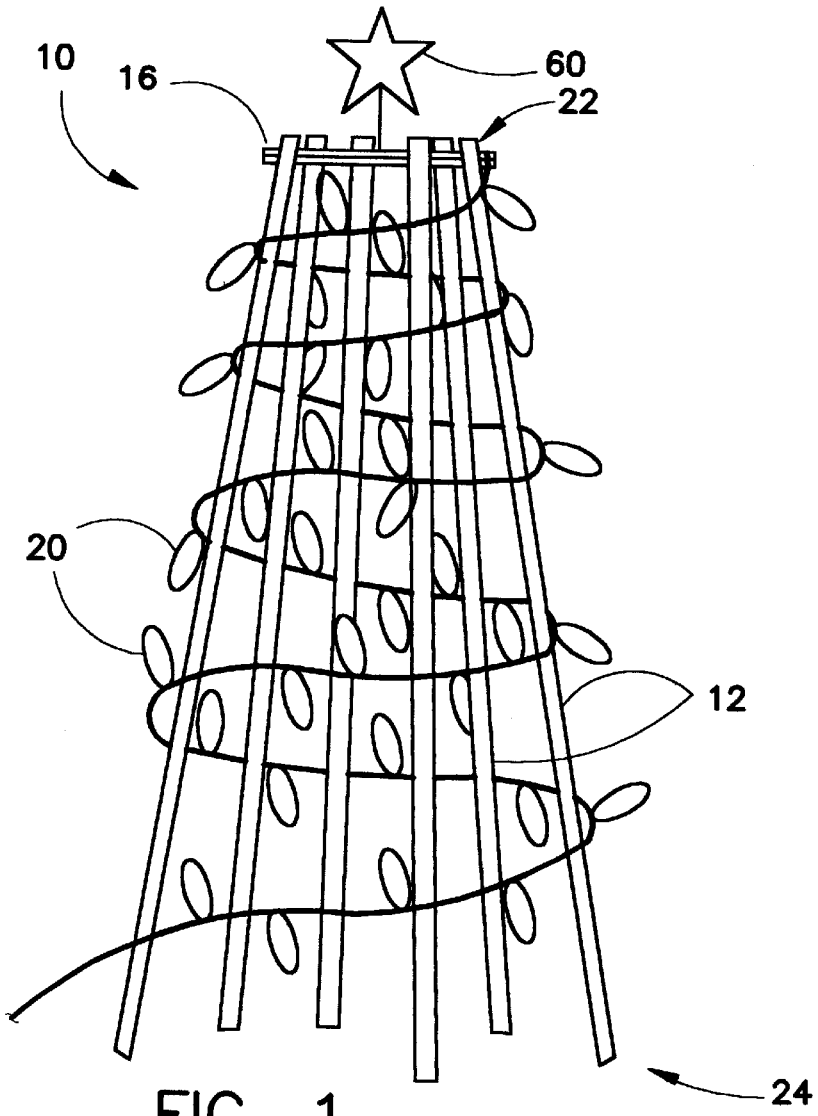
FIG. 1 is a perspective view illustrating a simulated Christmas tree light display constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, a simulated Christmas tree light display, generally designated, is shown constructed according to the present invention. The display includes a number of legs 12 connected together at a first end by a ring 16. The legs are movably attached to the ring 16 to provide for a variety of display dimensions from a taller display having a narrower base to a shorter display with a wider base. At least one string of lights 20 is wrapped about the legs to give the appearance of a lighted Christmas tree.

Legs 12 have an equal length to provide for a display having stability and a uniform shape. Legs 12 may be of any length depending upon the desired height and shape of the tree. At least three legs 12 should extend from the ring 16 to form a tree-shape and allow the display to be free-standing. There may be more than three legs, as the number of legs is only limited by the number that can fit onto the ring 16.

In one embodiment, as illustrated in FIG. 1, six legs 12 extend from the ring 16. Each leg 12 includes an aperture 26 placed at the first end. In a preferred embodiment, the upper edge of the aperture is about ⅛ inch from the leg first end 22 and has a 7/32 inch diameter. The leg second end 24 may be inserted into the ground when used outdoors to provide further stability. Alternatively, the second end 24 may be equipped with a shoe or other covering to prevent scratching or damage to furniture or other surfaces upon which the tree is displayed. The legs can be constructed from a variety of materials including aluminum, wood, or other. A color coating may be applied to the legs to assist in the tree-like appearance.

Figure 3:
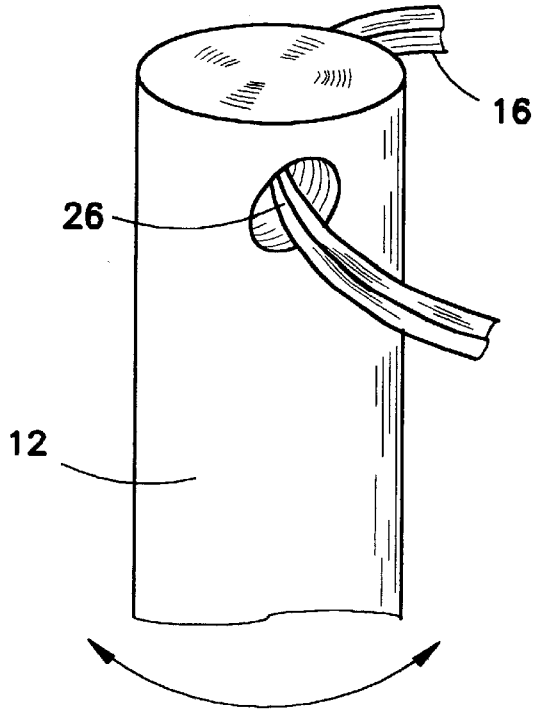
FIG. 3 is a perspective cut-away view illustrating one leg of the simulated tree having a portion of the upper ring extending through an aperture in the upper end of the leg.
Figure 4:
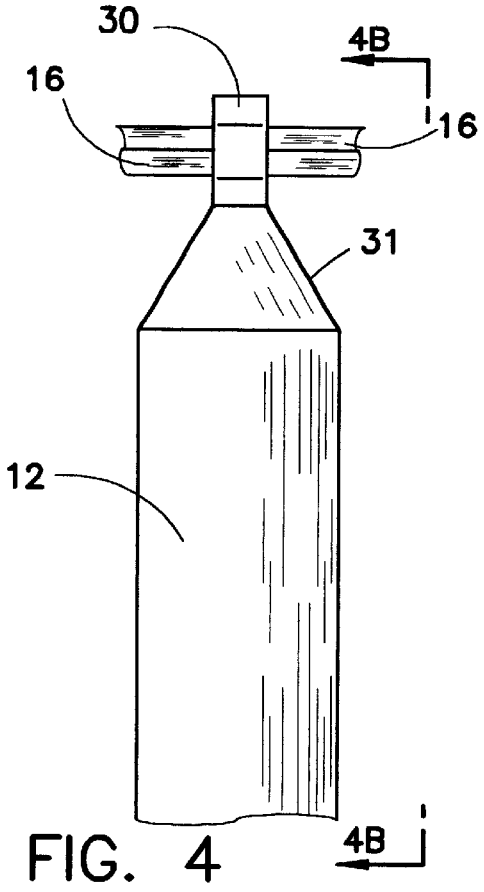
FIG. 4 is a side view of an alternative embodiment of the leg having a flatten end connected to the upper ring.
Figure 4B:
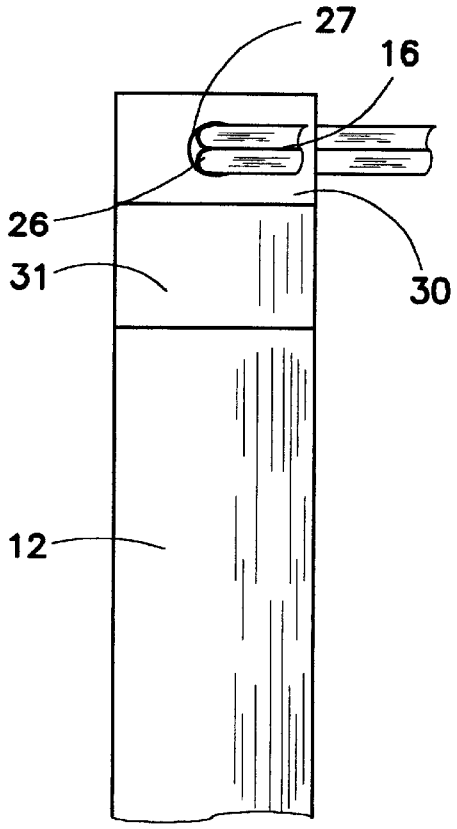
FIG. 4B is a side view of the alternative embodiment illustrated in FIG. 4A, taken along lines 4B—4B.
Figure 6:
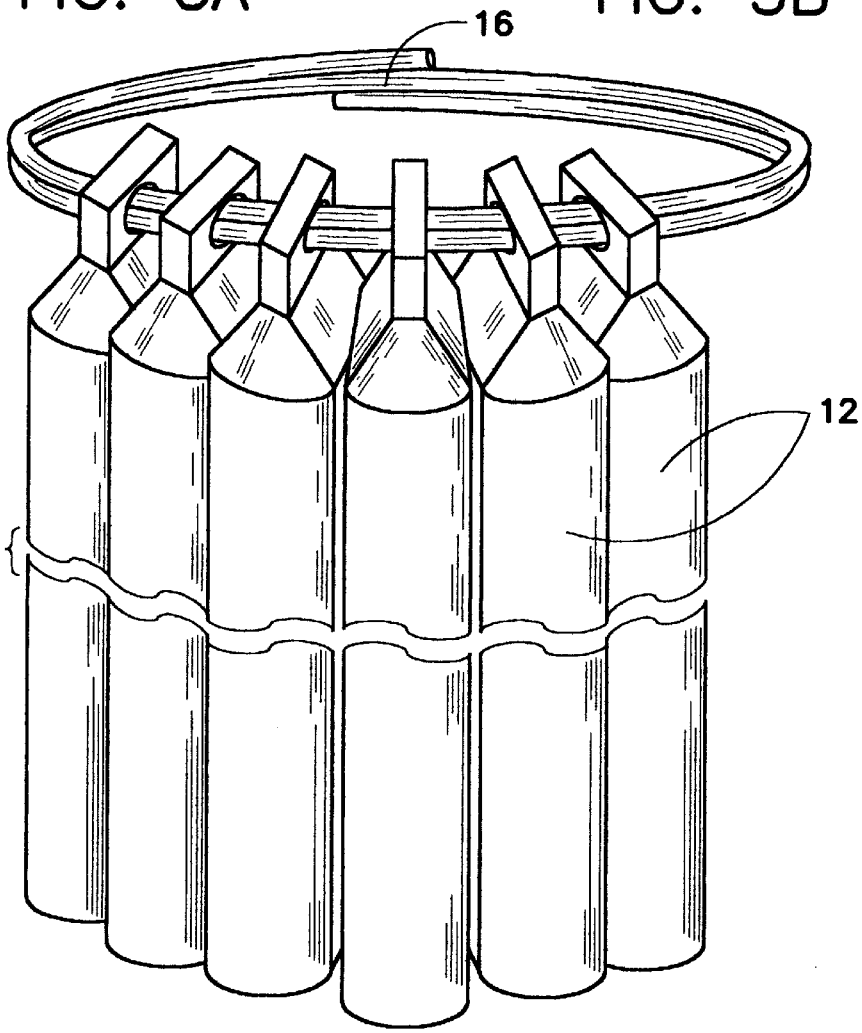
FIG. 6 is a perspective view of the display in a storage position.

The legs 12 may have a variety of cross-sectioned shapes. In one embodiment the legs 12 have a substantially circular cross-sectional shape extending the entire leg length, such as one embodiment having a ¼" rod, as illustrated in FIG. 3. Another embodiment is illustrated in FIG. 6 having a flattened cross-section. In another embodiment, as illustrated in FIGS. 4A and 4B, the legs 12 have a tapered section 31 and a flattened end section 30. The flattened end section 30 provides for easier manufacturing, connection to the ring 16 and provides space for more additional numbers of legs to be connected to the ring than could accommodated by unflattened ends.

Figure 2:
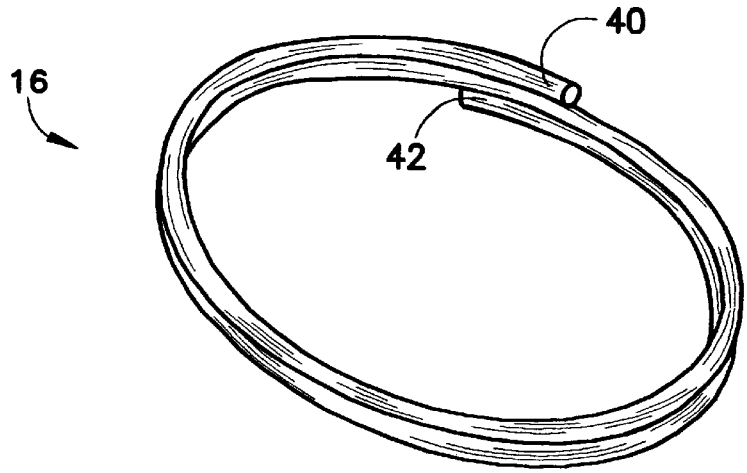
FIG. 2 is a perspective view of an upper ring for the simulated Christmas tree light display shown in FIG. 1.

Ring 16 extends through the leg apertures 26, as illustrated in FIG. 1. Preferably, ring 16 has a spring-type construction having a first end 40 and a second end 42. The user threads each of the legs 12 onto the ring 16 by inserting the first end 40 into the aperture 26 and threading it around the ring and through the second end 42 such that the ring is completely contained within the aperture 26. In the preferred embodiment, ring 16 has a 2" diameter and is constructed of steel. As best seen in FIG. 2, in the preferred embodiment, the ends of the ring pass each other at least two times (e.g. 2 theta).

Also, in the preferred embodiment, the aperture diameter in the upper end of each leg is larger than the cross-sectional diameter of the wire forming the ring 16 to allow for each leg 12 to more easily rotate about the ring. Rotation of the legs relative to the ring provides for the display to have a variety of shapes ranging from the legs being substantially 0° normal to the surface of the ring to about 90° to the normal. Therefore, a display having legs extending 5 feet has a height of 5 feet when the legs are substantially perpendicular to the ground and a height of about 3.5 feet when the legs extend at about 45° from the normal drawn through the center of the display.

Figure 5A:
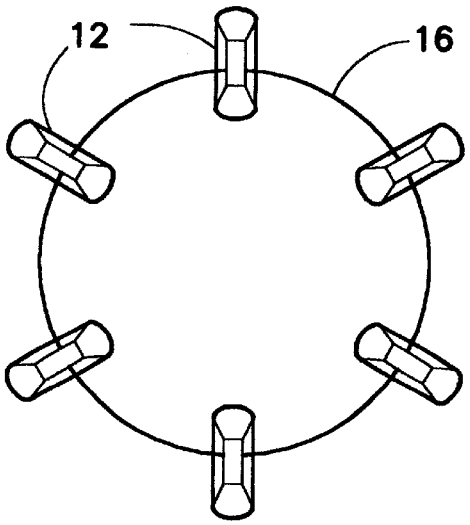
FIG. 5A is a schematic view of the top of the upper ring and attached legs.
Figure 5B:
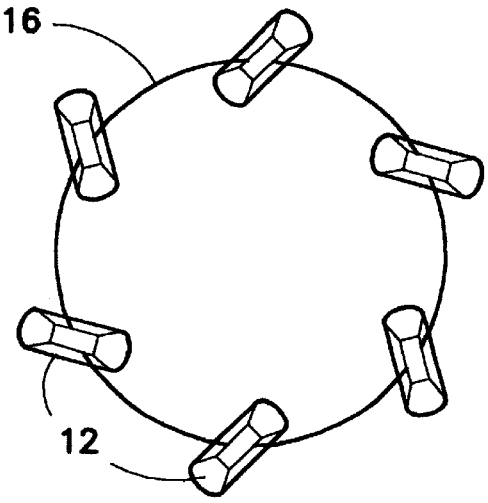
FIG. 5B is a schematic view of the top of the simulated tree shown in FIG. 5A after the upper ring has been rotated to lock the legs in position.

When the leg second ends 24 are firmly placed on the ground, the ring 16 may be rotated resulting in each leg twisting and locking onto the ring. FIG. 5A illustrates a top view of the legs attached to the ring. FIG. 5B illustrates after the ring is rotated, the legs twist such that the edges of the apertures 27 abut against the ring 16 to prevent movement of the legs making the display more rigid.

Light strings 20 may be wrapped about the legs, as illustrated in FIG. 1, to assist in providing the appearance of a Christmas tree. The light strings may be attached in a variety of orientations, such as helically wound, depending upon the desired display. The first end of the light string attached to the ring may include a clip or other connection device for attachment to the ring or top of one of the legs. Clips, ties, or other attachment members may further attach the light string to the display. A top 60 may further be attached to the display.

In use, the tree light display 10 may be assembled by threading the desired number of legs 12 onto the ring 16. Once connected, the legs can be placed at any desired angle to give the preferred design desired by the user. Light strings 20 may then be wrapped about the legs to further enhance the image of the tree. Alternatively, other wrapping indicia and ornaments may be wrapped about the tree individually or in combination with the light strings. Wrapping indicia may include strings of popcorn, garland, artificial or real pine, or other like materials.

The tree light display further provides for easy disassembly by unwrapping the light strings or other wrapping indicia, and either disconnecting the legs from the ring or simply grouping the legs together to take up a minimum of storage space. FIG. 6 illustrates the display in a storage position having the legs positioned together.

Certain modifications and improvements will occur to those skilled in the art upon a reading of the foregoing description. It should be understood that all such modifications and improvements have been deleted herein for the sake of conciseness and readability but are properly within the scope of the following claims.

I Claim:

1. A simulated Christmas tree light display comprising:

(a) a ring formed from an overlapping spring coil; and (b) a plurality of elongated legs each having a first end and a second end, said first end having an aperture through which said ring extends to connect said legs, each of said apertures being sized to allow said legs to pivot about said ring to form a variety of conical-shaped designs.

2. The display of claim 1, further including at least one light string wrapped around said display providing the appearance of a lighted Christmas tree and means for attaching said light string to adjacent portions of said legs.

3. The display of claim 2, wherein said light string is helically wrapped about said display.

4. The display of claim 1, wherein wrapping indicia is placed around said display.

5. A simulated Christmas tree light display comprising:

(a) a generally circular ring formed from an overlapping, spring coil; and (b) a plurality of elongated legs each having a first end and a second end, said first end having a flattened end section having an aperture through which said ring extends to connect said legs, each of said apertures being sized to allow said legs to pivot about said ring to form a variety of conical-shaped designs.

6. The display of claim 5, wherein said legs are substantially equal in length.

7. The display of claim 5, wherein between 3 and 6 legs are attached to said ring.

8. The display of claim 5, wherein the flattened end section of said legs pivots about said ring between about 0 and 90 degrees relative to normal to the surface of the ring thereby permitting said display to be positioned into a variety of shapes.

9. The display of claim 5, wherein said legs are coated with a colored material to simulate the appearance of a tree.

10. The display of claim 5, wherein said ring is formed from an overlapping coil wherein the ends of said coil overlap one another at least twice.

11. The display of claim 10, wherein said ring is a circle having a diameter between about 1-½ and 2-½ inches.

12. The display of claim 5, further including an ornament attached to said ring for providing a top piece for said tree display.

13. The display of claim 5, wherein said elongated leg apertures abut against said ring upon the rotation of said ring for locking said tree display into position.

14. A simulated Christmas tree light display comprising:

(a) a generally circular ring formed from an overlapping, spring coil;

(b) a plurality of elongated legs each having a first end and a second end, said first end having a flattened end section having an aperture through which said ring extends to connect said legs, each of said apertures being sized to allow said legs to pivot about said ring to form a variety of conical-shaped designs; and (c) at least one light string wrapped around said display providing the appearance of a lighted Christmas tree and means for attaching said light string to adjacent portions of said legs.

15. The display of claim 14, wherein said light string is helically wrapped about said display.

16. The display of claim 14, wherein wrapping indicia is placed around said display.

17. The display of claim 14, wherein said legs are substantially equal in length.

18. The display of claim 14, wherein between 3 and 6 legs are attached to said ring.

19. The display of claim 14, wherein the flattened end section of said legs pivots about said ring between about 0 and 90 degrees relative to normal to the surface of the ring thereby permitting said display to be positioned into a variety of shapes.

20. The display of claim 14, wherein said legs are coated with a colored material to simulate the appearance of a tree.

21. The display of claim 14, wherein said ring is an overlapping coil having ends that overlap one another at least twice.

22. The display of claim 21, wherein said ring is a circle having a diameter between about 1-½ and 2-½ inches.

23. The display of claim 14, further including an ornament attached to said ring for providing a top piece for said tree display.

24. The display of claim 14, wherein said elongated leg apertures abut against said ring upon the rotation of said ring for locking said tree display into position.

* * * * *